US009708691B2

(12) United States Patent
Johns

(10) Patent No.: US 9,708,691 B2
(45) Date of Patent: Jul. 18, 2017

(54) PROCESS FOR INVESTMENT CASTING AND CASTING GRAIN FOR USE IN THE PROCESS

(75) Inventor: Peter Gamon Johns, Hertfordshire (GB)

(73) Assignee: ARGENTIUM INTERNATIONAL LTD (GB)

( * ) Notice: Subject to any disclaimer, the term of this patent is extended or adjusted under 35 U.S.C. 154(b) by 896 days.

(21) Appl. No.: 13/036,288

(22) Filed: Feb. 28, 2011

(65) Prior Publication Data

US 2011/0139318 A1 Jun. 16, 2011

Related U.S. Application Data

(63) Continuation-in-part of application No. 11/942,827, filed on Nov. 20, 2007, now abandoned, which is a (Continued)

(30) Foreign Application Priority Data

| | | |
|---|---|---|
| Jun. 2, 2004 | (GB) | 0412256.0 |
| Sep. 23, 2004 | (GB) | 0421172.8 |
| May 20, 2005 | (GB) | 0510243.9 |
| Nov. 11, 2005 | (GB) | 0523002.4 |
| Nov. 11, 2010 | (GB) | 1019071.8 |

(51) Int. Cl.
*B22D 21/00* (2006.01)
*B22D 21/02* (2006.01)
(Continued)

(52) U.S. Cl.
CPC ..... *C22C 1/06* (2013.01); *B22C 9/04* (2013.01); *B22D 21/00* (2013.01); *B22D 21/02* (2013.01);
(Continued)

(58) Field of Classification Search
CPC C22C 1/02; C22C 1/10; C22C 1/1036; C22C 5/06; C22C 5/08
USPC ..... 11/538, 559, 678, 405, 430, 431; 420/501–506; 148/538, 559, 678, 405, 148/430, 431
See application file for complete search history.

(56) References Cited

U.S. PATENT DOCUMENTS 4,106,945 A * 8/1978 Erndt ..... B22C 1/00 106/38.3
4,810,308 A * 3/1989 Eagar et al. ..... 148/538
(Continued)

FOREIGN PATENT DOCUMENTS

GB 0510243.9 5/2005
GB 0523002.4 11/2005
(Continued)

OTHER PUBLICATIONS

"Evaluation of Hot Tearing in 925% Silver Alloys", ProGold Srl.
"Machining of Wedding-rings", Rudolf-Diesel-Ring 3, D-82054 Sauerlach, Germany.

*Primary Examiner* — Roy King
*Assistant Examiner* — Vanessa Luk
(74) *Attorney, Agent, or Firm* — Withers Bergman LLP

(57) ABSTRACT

In an Ag, Cu, Ge alloy containing boron as grain refiner, investment castings of a clean bright silvery appearance and/or free from cracking defects are obtained by incorporation of silicon, in some embodiments in the absence of added zinc.

25 Claims, 2 Drawing Sheets

Related U.S. Application Data continuation-in-part of application No. 11/628,260, filed as application No. PCT/GB2005/050074 on May 27, 2005, now abandoned, said application No. 11/942,827 is a continuation-in-part of application No. 11/628,260, filed as application No. PCT/GB2006/050116 on May 19, 2006, now abandoned.

(51) Int. Cl.

| | |
|---|---|
| ***C22C 5/08*** | (2006.01) |
| ***C22C 1/06*** | (2006.01) |
| ***B22C 9/04*** | (2006.01) |
| ***C22C 1/02*** | (2006.01) |
| ***C22C 1/03*** | (2006.01) |
| ***C22C 5/06*** | (2006.01) |
| *C21D 6/02* | (2006.01) |

(52) U.S. Cl.

CPC ..... *C22C 1/02* (2013.01); *C22C 1/03* (2013.01); *C22C 5/06* (2013.01); *C22C 5/08* (2013.01); *C21D 6/02* (2013.01)

(56) References Cited

U.S. PATENT DOCUMENTS

| | | | | |
|---|---|---|---|---|
| 5,039,479 | A * | 8/1991 | Bernhard et al. | 420/504 |
| 6,493,912 | B1 * | 12/2002 | Ho | 29/10 |
| 6,726,877 | B1 * | 4/2004 | Eccles | 420/504 |
| 2006/0045792 | A1 * | 3/2006 | Agarwal et al. | 420/504 |

FOREIGN PATENT DOCUMENTS

| | | | | |
|---|---|---|---|---|
| GB | 1019071.8 | | 11/2010 | |
| WO | WO96/22400 | * | 7/1996 | C22C 5/06 |
| WO | WO02/095082 | * | 11/2002 | C22F 1/00 |

* cited by examiner

PROCESS FOR INVESTMENT CASTING AND CASTING GRAIN FOR USE IN THE PROCESS

REFERENCE TO PRIOR APPLICATIONS

This application claims priority from UK Patent Application No. 10 19071.8 filed 11 Nov. 2010. It is a continuation-in-part application of U.S. patent application Ser. No. 11/942,827 filed 20 Nov. 2007 (US 2008-0069722) which is a continuation-in-part of U.S. patent application Ser. No. 11/628,260 filed 12 Jan. 2006 (US 2007-0251610) which is a 371 of International patent application PCT/GB2005/050074 filed 27 May 2005 (Publication No. WO 2005/118903) which claims priority from UK Patent Application 04 21172.8 filed 23 Sep. 2004 and UK Patent Application 04 12256.0 filed 2 Jun. 2004. It is also a continuation in part of PCT/GB2006/050116 filed 19 May 2006 (International Publication No WO 2006/123190) which claims priority from UK Patent Application No. 05 23002.4 filed 11 Nov. 2005 and UK Patent Application No. 05 10243.9 filed 20 May 2005. The disclosure of each application is hereby incorporated by reference in its entirety where appropriate for teachings of additional or alternative details, features or technical background, and priority is asserted from each.

FIELD OF THE INVENTION

The present invention relates to a process for lost wax investment casting of silver alloys and to casting grain for use in the above process.

BACKGROUND TO THE INVENTION

References published since 2 Jun. 2004 are mentioned to show current thinking concerning silver alloys and investment casting and in some cases to show uncontroversial matters of technical fact, but are not admitted as prior art.

Investment casting of sterling silver and standard deox alloys is reviewed by Jörg Fischer-Bühner, *Silver casting revisited: the alloy perspective*, The Santa-Fe Symposium 2010, the contents of which are incorporated herein by reference. However, to facilitate understanding of the historical development of significant silver alloys for investment casting and other purposes, patent specifications are discussed in the order of their earliest priority dates which are given after the name of the first listed inventor. It has not been convenient to preserve this chronological order for published literature in which the significance of the patented alloys is discussed.

It has long been desired to produce investment castings in silver with a bright and shiny as-cast colour. So-called "de-ox" sterling silver alloys are available inter alia from United Precious Metal Refining, Inc. ("UPM") which claims on its website to have the only available silicon-deoxidized sterling silver casting grains and which are said to have the advantages of castability, reduced porosity, absence of firescale and tarnish resistance.

U.S. Pat. No. 4,973,446 (Bernhard I, UPM, 1990) explains that molten silver can absorb 22 times its volume of oxygen, so that molten silver when close to saturation has an oxygen content of about 0.3 wt %, and further explains that copper has a high affinity for oxygen forming cuprous or cupric oxide. Unless air is excluded during the casting process, standard Sterling silver castings may suffer from gas porosity and firestain. A problem with which the inventors were concerned was therefore to provide a silver alloy composition which exhibited reduced porosity when recast (e.g. from casting grain), which substantially reduced the formation of firescale in the casting process and which exhibited reduced grain size. As noted e.g. by Fischer-Bühner, *Advances in the Prevention of Investment Casting Defects Assisted by Computer Simulation*, Santa-Fe symposium, 2007 (the contents of which are incorporated herein by reference) the investment material has "tremendously low thermal conductivity" compared to all casting alloys independent of their chemical composition, which leads to solidification times of ~90 seconds in the sphere part of a standard ring model for standard Sterling silver (FIG. 1), and consequently increased grain growth and reduced hardness compared to ingot-cast silver. The disclosed solution was an alloy consisting essentially of the elements set out in the table below. The alloy was said to produce castings free of normal firescale, with the additional advantages of greatly-reduced porosity and a reduced grain size leading to reduced labour in finishing and a reduced rejection rate of recast articles.

In the Bernhard I alloys, silver is present in the necessary minimal percentage to qualify as either coin silver or sterling silver, as appropriate. Copper (2.625 wt %) is added as a conventional hardening agent for silver as well as the main carrying agent for the other materials. Zinc is added to reduce the melting point of the alloy, to add whiteness, to act as a copper substitute, as a deoxidant, and to improve fluidity of the alloy. Tin is added to provide tarnish resistance, and for its hardening effect. Indium is added as a grain refining agent and to improve the wettability of the alloy. Silicon (0.1 wt %) acts as a deoxidant that reduces the porosity of the recast alloy and has a slight hardening effect. Boron is added to reduce the surface tension of the molten alloy and to allow it to blend homogeneously. A typical composition comprised 92.5 wt % silver, about 0.5 wt % copper, about 4.25 wt % zinc, about 0.48 wt % tin, about 0.02 wt % indium, about 1.25 wt % of a boron-copper alloy containing 2% boron and 98% copper, and 1% of a silicon-copper alloy containing about 10% silicon and about 90% copper. There is no disclosure or suggestion that silicon should be used as a deoxidant in the absence of zinc or at low levels of zinc.

U.S. Pat. No. 5,039,479 (Bernhard II, 1990) describes a master metal composition for making alloys of the above type, tin apparently being optional. An alloy used as a reference example in EP-B-0752014 (Eccles I) and said to be made in accordance with Bernhard II consists of silver 92.5 wt %, copper 3.29 wt %, zinc 3.75 wt %, indium 0.25 wt %, boron 0.01 wt % and silicon 0.2 wt %; it is reasonable to conclude that this is an analysis of a commercial alloy of UPM. Again there is no disclosure or suggestion that silicon should be used as a deoxidant in the absence of zinc or at low levels of zinc content.

As previously explained, the above mentioned disclosures concerning deox alloys should not be interpreted as disclosing the use of silicon as an individual element. Fischer-Bühner 2010 discloses in relation to zinc that together with silicon it serves as a deoxidant. As is apparent from the table below which is reproduced from Fischer-Bühner 2010, Si-containing deox alloys all contain large amounts of zinc. If UPM and other manufacturers had been able to obtain bright castings with less zinc or without zinc, they would have done so because zinc (b.p. 907° C.) is volatile at silver casting temperatures (~1000° C.), reduces hardness and gives rise to gas porosity and shrinkage porosity.

| Category | Alloy code | Silicon | Zinc | Comment |
|---|---|---|---|---|
| High Si-content | Arg-Deox | ++++ | +++ | Highest fluidity, firestain and oxidation resistance and reduction of tarnish rate |
| Low to medium Si-content | SF928CHA<br>AG113MA<br>AG114MA | +++<br>++<br>+ | +++<br>+++<br>++ | Medium-to-high firestain and oxidation resistance, reliability and user-friendliness |
| Si-free | S925PHA<br>S925PTA | – no –<br>– no – | +++<br>+ | Most easy-to-cast and forgiving, universal usage, high productivity |

Patent GB-B-2255348 (Rateau, 1991) discloses a silver alloy that maintains the properties of hardness and lustre inherent in Ag—Cu alloys while reducing problems resulting from the tendency of the copper content to oxidise. The alloys are ternary Ag—Cu—Ge alloys containing at least 92.5 wt % Ag, 0.5-3 wt % Ge and the balance, apart from impurities, copper. The alloys are stainless in ambient air during conventional production, transformation and finishing operations, are easily deformable when cold, are easily brazed and are said not give rise to significant shrinkage on casting. They also exhibit superior ductility and tensile strength. Germanium exerts a protective function that is responsible for the advantageous combination of properties exhibited by the new alloys, and is in solid solution in both the silver and the copper phases. The microstructure of the alloy is said to be constituted by two phases, a solid solution of germanium and copper in silver surrounded by a filamentous solid solution of germanium and silver and copper which itself contains a few intermetallic Cu—Ge dispersoids. The germanium in the copper-rich phase inhibits surface oxidation of that phase by forming a thin GeO and/or $GeO_2$ protective coating that prevents firestain during brazing and flame annealing. Furthermore the development of tarnish is appreciably delayed by the addition of germanium, the surface turning slightly yellow rather than black and tarnish products being easily removed by ordinary tap water. The alloy is useful inter alia in jewelery and silversmithing. Conventional grain-refining agents were tested, the specific materials evaluated or suggested being gold, nickel, manganese or platinum. Investment casting of the alloy was not reported.

As a result of discussions with Melvin Bernhard of UPM, Anthony Eccles of Apecs Investment Castings Pty Ltd developed alloys disclosed in EP-B-0752014 (Eccles I, 1993) for which the broadly claimed ranges of constituent elements is set out in the Table below. As explained in Anthony Eccles, *The Evolution of an Alloy*, The Santa-Fe Symposium, 1998 the alloy marketed by UPM was firescale-free on casting, but in its as-cast state it was too soft for most jewelery purposes and it did not harden appreciably. The present applicants consider that a hardness of 65-70 HV is needed for jewelery. The way these disadvantages were expressed in Eccles I was that the Bernhard I and Bernhard II alloys exhibited poor work hardening properties and did not achieve the mechanical strength of worked goods in traditional sterling silver. That disadvantage was disclosed as being overcome by addition of germanium to silver alloys of high zinc content broadly similar to those of Bernhard, the germanium-containing alloys reportedly having work hardening characteristics comparable to those of conventional 925 Sterling alloys together with firescale resistance. Zinc was said to influence the colour of the alloy and to act as a reducing agent (i.e. deoxidiser) for silver and copper oxides. Silicon was said to provide firescale resistance and to maintain good colour. Indium and boron could be provided for modification of rheology, reduction in surface tension and grain refinement. Exemplified alloys contained 2-3 wt % zinc and 0.15-0.2 wt % Si together with boron indium and germanium. The present inventors believe that Eccles was also driven to maintain high levels of zinc in the alloy by the need to avoid firestain at the time of casting, the problems created by high levels of zinc being such that if he had found any other way of achieving the same effects in a satisfactory alloy, he would have done so.

Eccles I was silent about the casting conditions employed. A skilled person is aware that as-cast hardness is dependent upon casting conditions. The present inventor has inferred that the figures quoted by Eccles are for ingot casting where cooling is very rapid and there is little opportunity for grain growth, cast ingots normally being rolled as in the experiments reported by Eccles and work hardening alluding to the manufacture of sheet and wrought products. As noted e.g. by Fischer-Bühner, *Advances in the Prevention of Investment Casting Defects Assisted by Computer Simulation*, Santa-Fe symposium, 2007 (the contents of which are incorporated herein by reference) the investment material has "tremendously low thermal conductivity" compared to all casting alloys independent of their chemical composition, which leads to solidification times of ~90 seconds in the sphere part of a standard ring model for standard Sterling silver, and consequently increased grain growth and reduced hardness compared to ingot-cast silver. The hardness of APECS Bright Silver 925 said to be made in accordance with Eccles I (Ge content 0.2-0.3 wt %) is very significantly less than standard Sterling when investment cast with HV<50. The cast metal said to work harden to >160 HV at 75% rolling reduction, and is said to age harden to 120 HV by heating to an annealing temperature of 700° C. and quenching. It does not age harden without heating to an annealing temperature and quenching because of its low germanium content. Eccles I made no reference to investment casting. Insofar as APECS Bright Silver 925 is concerned a skilled person would regard the HV as investment cast as too low to be practical and would reject the age hardening route as involving conditions of a severity that are impractical for investment cast products owing to cracking and deformation, and for example would be impossible for products where stones are cast in place. Eccles I, therefore, does not solve the problem of providing an alloy that is practical for lost wax investment casting applications.

WO 96/22400 (Eccles II, 1995) refers to Eccles I and implicitly confirms the softness of the alloys of Eccles I insofar as it explains that for some alloys an increased copper content is required for increased hardness. It therefore aimed to provide high-copper alloys that exhibited reduced firescale, reduced porosity and oxide formation and reduced grain size relative to standard sterling silver. The disclosed solution was to provide alloys having the general composition set out in the table below, optional constituents being in brackets. It will be noted that the novelty over Eccles I was the absence of zinc, although high tin contents were considered acceptable. The specification explained that high copper alloys are inherently firescale-prone and that to create a high copper content, firescale-free sterling silver was unexpected. In particular it was unexpectedly found that the choice of deoxidizing additive (silicon) provided the facility of high copper content without significant firescale production, whereas the more common aggressive deoxidizers such as zinc did not. Firescale resistance was considered to be of particular importance for hot working to impart hardness and the use of germanium as an alloying agent provided alloys which were both firescale resistant and work hardenable and which were harder than prior art alloys due to their elevated copper content. Rheology-modifying additives such as indium and boron were optional ingredients but the ability of boron to act as a grain refiner had not yet been disclosed and its importance was not noted. Disclosed embodiments were Ag—Cu—Ge—Si and Ag—Cu—Ge—Si—In alloys and there was no boron-containing embodiment, a reference to fewer components providing the added advantage of a more stable grain structure teaching away from the addition of boron. The only exemplified alloys contained 0.2-0.3 wt % Si and 0.2-0.3 wt % Ge.

The Eccles II alloys were never developed into a commercial product despite their apparently desirable properties. One reason may be an insufficient level of germanium in the exemplified materials to give rise to the desirable properties in terms of firescale resistance, tarnish resistance and hardness associated with that element. There would have been a propensity for crack development especially when investment casting owing to the relatively high silicon content. The absence of boron would have hindered grain refinement so that investment castings in the Bernhard II alloy would have been unacceptably soft. None of Bernhard I, Bernhard II, Eccles I and Eccles II discloses or suggests a solution to these problems. Furthermore, Eccles II is completely silent about lost wax investment casting about and the repeated mention of platework, rolling and work hardening teaches away from the use of these alloys for lost wax investment casting.

U.S. Pat. No. 6,168,071 (Johns, 1998) describes and claims inter alia a silver/germanium alloy having an Ag content of at least 77% by weight, a Ge content of between 0.5 and 3% by weight, the remainder being copper apart from any impurities, which alloy contains boron as a grain refiner at a concentration of up to about 20 ppm. The boron is provided as a copper-boron alloy e.g. containing 2 wt % boron and imparts greater strength and ductility to the alloy and permitting strong and aesthetically pleasing joints to be obtained using resistance or laser welding. It was explained that grain refining silver alloys had proved difficult and that a person of ordinary skill in the art would not previously have considered boron for this purpose, and that it is effective in inhibiting grain growth even at soldering temperatures. Again investment casting of the alloy was not reported.

EP-B-1631692 (Johns II) discloses firestain and tarnish-resistant ternary alloy of silver, copper and germanium containing from more than 93.5 wt % to 95.5 wt % Ag, from 0.5 to 3 wt % Ge and the remainder, apart from incidental ingredients (if any), impurities and grain refiner, copper. Investment casting of strip is reported and the strip is said to be free of hot short (cracking) defects. The appearance of the strip as cast was not evaluated. Although the bracketed ingredients in the table below were optionally present as a hypothetical possibility, in practice alloys containing them were not made or tested.

| Element | Bernhard I wt % | Eccles 1 wt % | Eccles II wt % | Rateau wt % | Johns wt % | Johns II wt % |
|---|---|---|---|---|---|---|
| Ag | 89-93.5 | >90 | To 100% | ≥92.5 | ≥92.5 | 93.5-95.5 |
| Cu | 0.5-6 | 0.5-6 | 2.5-19.5 | 4.5-7.2 | 4.5-7.2 | balance |
| Ge | N/A | 0.01-1 | 0.01-3.3 | 0.5-3 | 0.5-3 | 0.5-3 |
| Zn | 0.5-5 | 2-4 | | | | (0.5) |
| Tin | 0.25-2 | 0-6 | (0-6) | | | (0.5) |
| In | 0.01-1.25 | 0-1.5 | (0-1.5) | | | (trace) |
| Si | 0.01-2 | 0.02-2 | 0.02-2 | | | (0.1-1) |
| B | 0.01-2 | 0-2 | (0-2) | | ≤20 ppm | 1-40 ppm |

Various alloying ingredients are discussed by Fischer-Bühner in his 2010 paper which reflects current practice in the casting of alloys other than those which contain germanium.

Copper remains the main addition in variations of standard sterling silver despite its many disadvantages. It accelerates tarnishing. It lowers the melting point of silver and leads to a broad melting range, making the alloy intrinsically prone to hot cracking. It oxidizes easily, leading to dark surface oxide layers on as-cast trees during cooling in air after pouring or during re-heating, e.g. for soldering. It also leads to internal or subsurface oxidation which can be revealed as "firestain" (grey, bluish or reddish areas) on finished surfaces.

Zinc is used up to ~2.5 wt %. It decreases the surface tension of the melt, increases fluidity and form filling and reduces surface roughness. Together with silicon it helps to avoid the development of dark copper oxide layers and firestain. However, the high vapour pressure of zinc can lead to loss of Zn by evaporation depending on melting conditions and to fumes of zinc.

Silicon is used up to ~0.2 wt %. It has a greater affinity for oxygen than silver, copper and zinc and therefore acts as deoxidizer of the molten alloy, but depending on equipment and process conditions it can also give rise to surface dross. It prevents the formation of dark copper oxide layers by preferential formation of bright and white silicon-oxide layers on as-cast trees. Like zinc it increases fluidity and assists in form filling. It also widens the melting range and tends to segregate and form low-melting phases along grain boundaries, leading to increased risk of hot cracking. If used in high quantities, silicon and zinc may reduce the rate of tarnishing.

A bright and shiny as-cast tree colour is often a practical necessity, especially for companies carrying out stone-in-place casting. In such cases alloys with medium to high silicon level are at present considered by Fischer-Bühner the only safe choice (this statement being made in relation to alloys containing zinc and silicon but not germanium). While the dark copper oxide layers on as-cast tree surfaces obtained for silicon-free alloys can be removed by pickling, they are sometimes difficult to remove completely below the stones. A high silicon-level provides the most bright as-cast tree colour under all manufacturing conditions and the most white metal colour after finishing, making it particularly attractive for stone-in-place casting. Furthermore the higher fluidity of such an alloy allows for lower flask temperatures, which reduces the risk of damage to the stones Depending on alloy composition the brightness of as-cast trees also significantly depends on the cooling procedure of flasks after pouring. A common standard cooling procedure consists in removing the flask from the flask chamber ~1 min after pouring followed by cooling in air for another 10-20 min before quenching. For silicon-free alloys the surface of the as-cast tree then is covered by a grey to dark copper-oxide layer depending on flask temperature. The oxidation can be drastically reduced if a flask is kept for an extended time (e.g. 3-5 min) in the flask chamber under vacuum or protective gas which then is followed by removal of the flask from the machine and immediate quenching. In this case just a slight grey, sometimes yellowish discoloration is observed and internal (subsurface) oxidation of the copper in the alloy is avoided which eliminates firestain for Si-free alloys and significantly improves scrap metal quality. For Si-containing alloys such a process modification is not significant, since the brightness of the as-cast tree is not much affected by different flask cooling procedures. However, more protected cooling reduces consumption of silicon and also improves scrap metal quality.

Especially for alloys with a broad melting range, like all 925 silver alloys, "hot cracking" or "hot tearing" can be a problem. Hot cracking mainly occurs when mechanical stress is acting on the metal during the final stages of solidification, hence when there is only a small amount of liquid metal left between the growing grains. The thermal shrinkage of the solidifying metal coupled with the thermal expansion of the investment material (heating up when in contact with the hot metal) exerts local stresses and tears the metal apart. Fischer-Bühner explains that silicon-containing alloys are more prone to hot-cracking than silicon-free alloys. The increased risk for hot cracking of silicon-containing alloys as compared to silicon-free alloys can be theoretically understood. Silicon tends to segregate to grain boundary areas during solidification where it eventually forms low melting phases. This broadens the melting range, from a width of typically ~120° C. for silicon-free alloys to ~150-170° C. for medium-to-high silicon levels and also increases solidification time. For example an item that would need 1.5 min for completion of solidification if cast in a silicon-free alloy at a flask temperature of 500° C. needs around 2.5 min if cast in an alloy with medium-to-high silicon-content. Hence the danger zone (temperature and time range) during which hot cracking may occur is broadened for silicon-containing alloys. A further problem with silver castings is shrinkage porosity to which silicon-containing alloys are more prone.

SUMMARY OF THE INVENTION

In AgCuGe alloys germanium is a deoxidant resembling silicon, and such alloys can, for example, be torch annealed and remain bright and firestain-free. It was therefore expected that such alloys would give lost wax investment castings of bright silvery appearance. In many applications, however, when a casting in an AgCuGe alloy is removed from the investment it has a dark grey colour which can be time consuming and expensive to remove. Development of discoloration happened independently of whether the flask was cooled in air or in a protective atmosphere in the absence of oxygen for 10 minutes, so that the discoloration appeared not to involve oxidation. However, when investment castings were examined under high magnification extremely fine porosity resembling gas porosity was found at the surface of the castings, and it is believed that the presence of germanium gave rise to a metal-mould reaction that does not take place when silver alloys are investment cast that do not contain germanium. The discolouration has been a prolonged source of difficulty and it is not alleviated by the addition of conventional deoxidants such as zinc. The applicants believe that the discoloration may be the result of a hitherto unreported reaction between germanium at the surface of the casting and sulphate of the investment e.g. to give rise to argyrodite or silver germanium sulfide of formula $Ag_8GeS_6$ which is an iron-black mineral. Formation of that mineral would be consistent with the observed dark grey blemishes.

It has now been found that addition of silicon to the alloys when used in lost wax investment casting largely or completely avoids such discoloration and also in embodiments reduces cracking and porosity associated with conventional silicon-containing alloys, silicon being effective for this purpose in surprisingly small amounts. Surprisingly incorporation of silicon into germanium-containing silver alloys does not give rise to undue embrittlement (e.g. synergistically with germanium already present as feared to be possible) so that in embodiments rings may be made of AgCuGeSi alloy and stones may be set into claws of the rings without the claws breaking off.

Embodiments of the invention provides casting grain comprising at least 77 wt % silver, 0.2-3 wt % germanium, copper and boron as grain refiner, said casting grain further comprising silicon in an amount effective to inhibit discoloration and/or cracking during investment casting.

Embodiments of the invention provide casting grain of a silver-copper germanium alloy for producing lost wax investment castings having a clean silvery appearance when removed from the investment, said casting grain comprising at least 77 wt % silver, 0.5-3 wt % germanium, 0-1 wt % zinc, 0.001-0.2 wt % silicon and 3-60 ppm boron as grain refiner. As discussed below, oxygen content of the casting grain is desirably <40 ppm, excessive amounts of oxygen in the casting grain giving rise to loss of e.g. silicon and boron.

Embodiments of the invention relate to the use of silicon in a a silver-copper germanium alloy for investment castings, said alloy comprising at least 77 wt % silver, 0.2-3 wt % germanium, copper and boron as grain refiner, and said investment castings being free from discoloration arising in the casting process and exhibiting a clean silvery appearance.

Embodiments of the invention relate to the use of silicon in a a silver-copper germanium alloy for investment castings, said alloy comprising at least 77 wt % silver, 0.2-3 wt % germanium, copper and boron as grain refiner, and said investment castings exhibiting reduced or eliminated cracking defects.

Further embodiments of the invention provide a process for the investment casting of a silver-copper germanium alloy comprising at least 77 wt % silver and 0.2-3 wt % germanium to provide a casting having a clean silvery appearance when removed from the investment, said process comprising using an alloy containing silicon in an amount effective to impart said clean silvery appearance to the casting and boron in an amount effective to impart grain refinement.

Yet further embodiments of the invention provide a process for lost wax investment casting a germanium-containing silver alloy into a hydraulically set investment based on a gypsum binder to form a casting having a clean silvery appearance when removed from the investment, said process comprising:

melting casting grain of a silver-copper germanium alloy comprising at least 77 wt % silver and 0.5-3 wt % germanium, 0-1 wt % zinc, 0.001-0.2 wt % silicon and 3-60 ppm boron as grain refiner, the silicon optionally being added to the alloy at the time of melting the casting grain, and pouring the molten alloy into the investment and allowing the investment and alloy to cool.

Yet further embodiments of the invention provide a process for lost wax investment casting a germanium-containing silver alloy into a hydraulically set investment based on a gypsum binder to form a casting having a clean silvery appearance when removed from the investment, said process comprising:

melting casting grain of a silver-copper germanium alloy comprising at least 77 wt % silver and 0.5-3 wt % germanium, 0-1 wt % zinc, 0.001-0.1 wt % silicon and 3-60 ppm boron as grain refiner, the silicon optionally being added to the alloy at the time of melting the casting grain, pouring the molten alloy into the investment and allowing the investment and alloy to cool;

recovering the casting from the investment; and reheating the casting at 150-400° C. preferably about 200-300° C. to effect precipitation hardening thereof, reheating giving an increase of hardness of at least 15 HV.

BRIEF DESCRIPTION OF THE DRAWINGS

Tests for cracking during investment casting are illustrated in the accompanying drawings, in which.

DESCRIPTION OF PREFERRED EMBODIMENTS

Investment Casting

Figure 1:
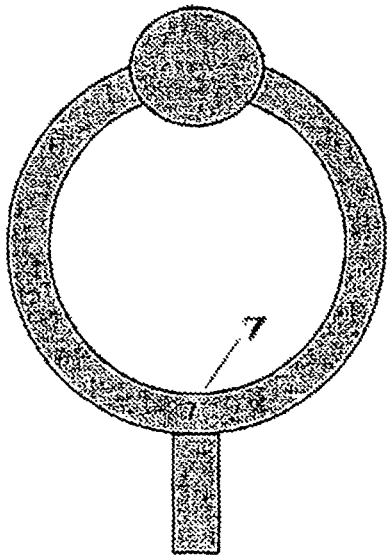
FIG. 1 is a diagram representing an alloy test casting for showing the performance of the alloy in investment casting of rings.

The general procedure for making solid investment moulds in the jewellery industry in centrifugal or vacuum assisted lost wax investment casting involves attaching patterns having configurations of the desired metal castings to a runner system to form a set-up or "tree". The patterns and runner system may be made of wax, plastics or other expendable material. To form the mould, the set-up or tree consisting of the pattern or patterns attached to the runner system are placed into a flask which is filled with an hydraulically hardenable refractory investment slurry (e.g. an gypsum-based slurry) that is allowed to harden in the flask around the tree or set-up to form the mould. A typical tree diameter is about 50 mm and when this is incorporated into an investment a typical investment diameter is about 100 mm. After the investment slurry is hardened, the patterns are melted out of the mould by heating in an oven, furnace or autoclave. The mould is then fired to an elevated temperature to remove water and burn-out any residual pattern material in the casting cavities. Casting is typically at a mould temperature of 500-600° C. using molten silver at 900-1000° C.

Conventional investment formulations used for non-ferrous moulds are comprised of a binder and a refractory made up of a blend of fine and coarse particles. A typical refractory usually is wholly or at least in part silica, such as quartz, cristabolite or tridymite. Other refractories such as calcined mullite and pyrophyllite also can be used as part of the refractory. Gypsum powder (calcium sulfate hemihydrate) is almost universally used as a binder for moulds intended for casting gold, silver and other metals and alloys having relatively low melting points. After de-waxing, when the temperature of the flask rises above 100° C. (212° F.), free water evaporates and gypsum ($CaSO_4.2H_2O$) begins to lose its water of hydration. However the complete transformation of gypsum into the anhydrous form of calcium sulphate (anhydrite) occurs over a wide temperature range, through complex transformations of the crystal lattice. These transformations take place with a considerable volume contraction, which is particularly severe at 300-450° C. (572-842° F.). If gypsum alone were used to produce investment for lost wax casting, the moulds would crack in service and would also produce castings a great deal smaller than the original patterns. Silica is used to compensate for this gypsum shrinkage and to regulate the thermal expansion of the mould. Silica exists in several crystalline forms, and two of them are used in the production of investment powders. Quartz is the most readily available form and its conversion from a to b crystal forms is accompanied by an increase in volume at around 570° C. (1058° F.). Cristobalite is the other major constituent of investment powder and this form of silica also undergoes a significant increase in volume as it transforms from its a to b crystal structure at around 270° C. (518° F.). Thus, these two allotropic forms of silica are used to override the shrinkage effect of the gypsum binder, and it is understood from the trade literature that many commercially available moulding particles are based on cristobalite, silica and gypsum Refractory moulding materials are mentioned in the patent literature. For example, a composition for making a refractory mould based on cristobalite, silica flour and gypsum is disclosed in U.S. Pat. No. 3,303,030 (Preston). U.S. Pat. No. 4,106,945 (Emdt) discloses that conventional non-ferrous investment formulations are comprised of a binder and a refractory made up of a blend of fine and coarse particles. The refractory usually is wholly or at least in part a silica, such as quartz, cristobalite or tridymite. Calcined fire-clay also is often used as a part of the refractory. The binder is typically a fine gypsum powder (calcium sulphate hemihydrate). The binder and refractory, together with minor chemical additives to control setting or hardening characteristics, are dry blended to produce the investment. The dry investment is then prepared for use by mixing it with sufficient water to form a slurry which can be poured into the flask around the set-up. Vacuuming of the slurry and vibration of the flask are frequently employed steps to eliminate air bubbles and facilitate filling of the flask. Pyrophyllite, a hydrous aluminium silicate, is present to prevent mould cracking, see also U.S. Pat. No. 5,310,420 (Watts). In practice manufacturers will use commercially available investment powders e.g. SRS Global available from Specialist Refractory Services Limited, Riddings, Derbyshire, UK or Gold Star XL, XXX, Gem Set or Omega+ available from Gold Star Powders of Newcastle-under Lyme, Staffordshire, UK or investment casting materials for jewellery casting available from Ransom & Rudolph of Maumee, Ohio, USA.

Silver Content

Embodiments of the present alloy have silver contents complying with the Sterling and Britannia standards.

Sterling silver has a minimum silver content of 92.5 wt %. However, embodiments have silver contents of 93-95.5 wt % e.g. about 93.5 wt % or above, the onset of reduction in copper elution compared to that with 925 alloys being believed to be in the range 93.0-93.5 wt % Ag.

A reason why it is feasible to reduce the copper content of the alloy to improve physical properties and reduce copper elution compared to standard 925 Argentium alloys is because of the unique hardening properties of the AgCuGe system. Incorporating germanium improves as-cast hardness. Further hardening can occur either by slow cooling alone (e.g. when an investment flask is allowed to air cool to ambient or near-ambient temperatures) or by low temperature baking which is advantageous because quenching any red hot silver alloy into cold water will always lead to cracking and solder joint failure. We have observed a surprising difference in properties between conventional sterling silver alloys and other silver alloys of the Ag—Cu family on the one hand and silver alloys of the Ag—Cu—Ge family on the other hand. Gradual cooling of e.g. the binary Sterling-type alloys results in coarse precipitates and little precipitation hardening, whereas gradual cooling of Ag—Cu—Ge alloys optionally containing incidental ingredients results in fine precipitates and useful precipitation hardening, especially in those embodiments where the silver alloy contains an effective amount of grain refiner e.g. boron.

Experimental evidence has shown that Ag—Cu—Ge alloys of Ag content 93.5 wt % and above become precipitation hardened following cooling from a melting or annealing temperature by baking at e.g. 200° C.-400° C. and that baking the alloy can achieve a hardness of 65 HV or above, preferably 70 HV or above and still more preferably 75 HV or above which is equal to or above the hardness of standard sterling silver used to make jewellery and other silverware. These advantageous properties are believed to be the result of the combination of Cu and Ge in the silver alloy and are independent of the presence and amounts of Zn or other incidental alloying ingredients. However the commercially available alloy made according to Eccles I does not exhibit these properties and can only be age hardened on heating to an annealing temperature and quenching.

Addition of germanium to sterling silver changes the thermal conductivity of the alloy compared to standard sterling silver. The International Annealed Copper Scale (IACS) is a measure of conductivity in metals. On this scale the value of copper is 100%, pure silver is 106%, and standard sterling silver 96%, while a sterling alloy containing 1.1% germanium has a conductivity of 65%. The significance is that the Argentium sterling and other germanium-containing silver alloys do not dissipate heat as quickly as standard sterling silver or their non-germanium-containing equivalents, a piece will take longer to cool, and precipitation hardening to a commercially useful level (e.g. to about Vickers hardness 70 or above, preferably to Vickers hardness 110 or above, more preferably to 115 or above) can take place during natural air cooling or during slow controlled air cooling.

The benefit of not having to quench to achieve the hardening effect is a major advantage of the present silver alloys. There are very few times in practical production that a silversmith can safely quench a piece of nearly finished work. The risk of distortion and damage to soldered joints when quenching from a high temperature would make the process not commercially viable. In fact standard sterling can also be precipitation hardened but only with quenching from the annealing temperature and this is one reason why precipitation hardening is not used for sterling silver.

In order to distinguish the operations of annealing and precipitation hardening (which are regarded as distinct by silversmiths) annealing temperatures may be defined to be temperatures above 500° C., whereas precipitation hardening temperatures may be defined to be in the range 150° C.-400° C., the lower value of 150° C. permitting embodiments of the alloys of the invention to be precipitation hardened in a domestic oven.

Further embodiments of the present alloy are of Britannia silver which has a minimum silver content of 95.84 wt %, and will typically have a silver content of 96 wt %. Such alloys retain the ability to precipitation harden as described above. Silver contents in the range 96-97.2 wt % are also contemplated.

Germanium

Embodiments of the present alloy have germanium content of 0.5-3 wt %, in embodiments 0.5-1.5 wt % and in further embodiments 0.7-1.2 wt %. Embodiments of the 935 alloy and 960 alloy may have a germanium content of 0.7 wt % although for improved hardening properties 0.8 or 0.9 wt % may desirable, and improved performance and tarnish resistance may be obtained e.g. in the 935 alloy at a germanium content of 1.0-1.2 wt % e.g. 1.1 wt %.

Silicon

Silicon may be added in amounts of e.g. 10 ppm up to 0.2 wt % and may be added as elemental silicon or as a CuSi alloy containing e.g. 10-30 wt % Si, in some embodiments 10 wt % Si or alternatively as a AgSi alloy.

Both germanium and silicon are embrittling agents for silver alloys, since both of them can precipitate at grain boundaries either as intermetallics or in elemental form and the precipitated material is brittle. As explained in GB-A-2255348 germanium-containing alloys of Ge content <3 wt % may escape embrittlement because germanium remains in solid solution as intermetallics in the silver and copper phases. However, that specification also discloses that silicon which is insoluble in silver and only slightly soluble in copper gives rise to alloys which are brittle to varying degrees, as also taught by Fischer-Bühner (above). In the alloys with which this invention is concerned both germanium and silicon are associated with the copper content of the alloys and form a secondary phase at the grain boundaries which may be a phase of predominantly Cu—Ge—Si with some silver. The formation of this copper-germanium-silicon phase at the grain boundary would be expected on the basis of conventional teaching give a highly brittle alloy. In practice, in the embodiments specified herein, it does not. It was unexpected to be able to combine two elements known to give a brittle investment casting alloy in such a ratio as to give an alloy with embodiments having no brittleness problems, good flow and low porosity and no hot cracking However, the amount of silicon added should be kept as low as possible since silicon is about 10 times as effective as germanium as an embrittling agent for silver, even in alloys containing relatively large amounts of copper. Amounts of silicon in embodiments of the alloy may be 0.01-0.1 wt % in embodiments 0.05-0.1 wt % e.g. 0.05-0.08 wt % with a reference value of 0.07 wt % (700 ppm). In embodiments the wt % silicon is ≤20% of the weight % of germanium, e.g. ≤10% of the weight of the germanium e.g. about 10% of the weight of the germanium. The upper limit for silicon in molten metal for the investment casting stage is, as noted above, 0.2 wt %, preferably <0.15 wt %. Bright castings can surprisingly be obtained with low amounts of incorporated silicon e.g. 75 ppm or above. Above 0.2 wt % Si the incidence of hot cracking/brittleness is greatly increased. The above maximum wt % of silicon selected on the grounds of embrittling properties greatly decreases the overall effectiveness of silicon as the primary deoxidant present in the metal (not only to you have the uptake of oxygen by the silver but you also have complete solubility of the oxygen in any copper present in the alloy). In addition, when combined with oxygen silicon forms silicon dioxide which forms insoluble hard ceramic particles which are deleterious to the overall quality of the alloy if not removed prior to casting as they would cause hard spots in the finished castings which would lead to drag marks on polishing.

Boron

The use of boron as grain refiner is a practical necessity when investment casting silver having an appreciable content of germanium. It is advantageously introduced at the time of manufacture of casting grain which then has the boron content needed for grain refinement on re-melting and investment casting e.g. 3-60 ppm, typically 5-20 pp. especially about 10 ppm. The amount of boron added should be sufficient to bring about grain refinement but below levels at which boron hard spots appear.

A conventional method of introducing boron into a precious metal alloy or master alloy is through the use of 98 wt % Cu, 2 wt % B master alloy. Many manufacturers have been able to use that alloy without difficulty but others have reported that it introduces hard spots into the products. These hard spots are believed to be non-equilibrium phase $CuB_{22}$ particles that form in copper saturated with boron when cooled from the liquid phase to the solid phase. The hard spots may not be detected until after the precious metal jewellery alloy is polished and inspected resulting in needless expense for the processing of ultimately unsatisfactory product.

A boron compound may be introduced into molten silver alloy in the gas phase, advantageously mixed with a carrier gas, which assists in creating a stirring action in the molten alloy and dispersing the boron content of the gas mixture into said alloy. Suitable carrier gases include, for example, hydrogen, nitrogen and argon. The gaseous boron compound and the carrier gas may be introduced from above into a vessel containing molten silver e.g. a crucible in a silver-melting furnace, a casting ladle or a tundish using a metallurgical lance which may be an elongated tubular body of refractory material e.g. graphite or may be a metal tube clad in refractory material and is immersed at its lower end in the molten metal. The lance is preferably of sufficient length to permit injection of the gaseous boron compound and carrier gas deep into the molten silver alloy. Alternatively the boron-containing gas may be introduced into the molten silver from the side or from below e.g. using a gas-permeable bubbling plug or a submerged injection nozzle.

The alloy to be heated may be placed in a solid graphite crucible, protected by an inert gas atmosphere which may for example be oxygen-free nitrogen containing <5 ppm oxygen and <2 ppm moisture and is heated by electrical resistance heating using graphite blocks. Such furnaces have a built-in facility for bubbling inert gas through the melt. Addition of small quantities of thermally decomposable boron-containing gas to the inert gas being bubbled through the melt readily provides a desired few ppm or few tens of ppm boron content The introduction of the boron compound into the alloy as a dilute gas stream over an period of time, the carrier gas of the gas stream serving to stir the molten metal or alloy, rather than in one or more relatively large quantities, is believed to be favourable from the standpoint of avoiding development in the metal or alloy of boron hard spots. Compounds which may be introduced into molten silver or alloys thereof in this way include boron trifluoride, diborane or trimethylboron which are available in pressurised cylinders diluted with hydrogen, argon, nitrogen or helium, diborane being preferred because apart from the boron, the only other element is introduced into the alloy is hydrogen. A yet further possibility is to bubble carrier gas through the molten silver to effect stirring thereof and to add a solid boron compound e.g. $NaBH_4$ or $NaBF_4$ into the fluidized gas stream as a finely divided powder which forms an aerosol.

A boron compound may also be introduced into the molten silver alloy in the liquid phase, either as such or in an inert organic solvent. Compounds which may be introduced in this way include alkylboranes or alkoxy-alkyl boranes such as triethylborane, tripropylborane, tri-n-butylborane and methoxydiethylborane which for safe handling may be dissolved in hexane or THF. The liquid boron compound may be filled and sealed into containers of silver or of copper foil resembling a capsule or sachet using known liquid/capsule or liquid/sachet filling machinery and using a protective atmosphere to give filled capsules sachets or other small containers typically of capacity 0.5-5 ml, more typically about 1-1.5 ml. The filled capsules or sachets in appropriate number may then be plunged individually or as one or more groups into the molten silver alloy. A yet further possibility is to atomize the liquid boron-containing compound into a stream of carrier gas which is used to stir the molten silver as described above. The droplets may take the form of an aerosol in the carrier gas stream, or they may become vaporised therein.

Conveniently the boron compound is introduced into the molten silver alloy in the solid phase, e.g. using a solid borane e.g. decaborane $B_{10}H_{14}$ (m.p. 100° C., b.p. 213° C.). However, the boron is conveniently added in the form of either a boron containing metal hydride or a boron containing metal fluoride. When a boron containing metal hydride is used, suitable metals include sodium, lithium, potassium, calcium, zinc and mixtures thereof. When a boron containing metal fluoride is used, sodium is the preferred metal. Most preferred is sodium borohydride, $NaBH_4$ which has a molecular weight of 37.85 and contains 28.75% boron.

Boron can be added to the other molten components both on first melting and at intervals during casting to make up for boron loss if the alloy is held in the molten state for a period of time, as in a continuous casting process for grain. This facility is not available when using a copper/boron master alloy because adding boron changes the copper content and hence the overall proportions of the various constituents in the alloy.

It has been found that when adding a borane or borohydride that more than 20 ppm can be incorporated into a silver alloy without the development of boron hard spots. This is advantageous because boron is rapidly lost from molten silver: according to one experiment the content of boron in molten silver decays with a half-life of about 2 minutes. The mechanism for this decay is not clear, but it may be an oxidative process. It is therefore desirable to incorporate more than 20 ppm boron into an alloy as first cast i.e. before investment casting or before rolling into strip, and amounts of e.g. up to 60 ppm may be incorporated. Thus there could be produced according to the present method silver casting grain containing about 40 ppm boron, although in another embodiment the casting grain may be nominally about 10 ppm boron. Owing to boron loss during subsequent re-melting and investment casting, the boron content of finished pieces may be closer to the 1-20 ppm of the prior art, but the ability to achieve relatively high initial boron concentrations means that improved consistency may be achieved during the manufacturing stages and in the final finished products. Although sodium is lost during casting, alloys to which boron is added as sodium borohydride may on analysis show some ppm of sodium e.g. >5 but <100 ppm.

Incidental Ingredients

Embodiments of the present alloys are free from added zinc or other added metals save copper, germanium, boron and silicon and have the advantage inter alia of simplicity of formulation and of production. At higher silver contents and at relatively low germanium contents, addition of zinc in other embodiments may be desirable e.g. in amounts of 0.2-1 wt % e.g. about 0.4 wt %. Above 1 wt % zinc becomes unacceptably volatile. Other metals may be added in small amounts e.g. up to 0.2 wt % provided that they do not interfere with the overall properties of the alloy, and such metals include e.g. gallium which in some embodiments may further decrease cracking defects. In embodiments small amounts of indium may also be present, so that a 960 alloy may comprise boron in ppm amounts as grain refiner, indium, gallium, zinc, silicon, germanium, copper and silver.

Major alloying ingredients that may be used to replace copper in addition to zinc (e.g. in amounts of up to 1 wt % e.g. 0.5 wt %) are Au, Pd and Pt. Other alloying ingredients may be selected from selected from Al, Ba, Be, Cd, Co, Cr, Er, Ga, In, Mg, Mn, Ni, Pb Si, Sn, Ti, V, Y, Yb and Zr, provided the effect of germanium in terms of providing firestain and tarnish resistance is not unduly adversely affected. The weight ratio of germanium to incidental ingredient elements may range from 100:0 to 60:40, preferably from 100:0 to 80:20. In some current commercially available Ag—Cu—Ge alloys such as Argentium incidental ingredients are not added.

Procedure

Silver for investment casting is commonly supplied in the form of casting grain.

Deoxidation of silver to form casting grain is desirable if easily oxidisable alloying ingredients such as germanium, silicon and boron are to be incorporated successfully and consistently into a silver alloy. The oxygen content of fine silver sold as bullion is not of technical importance and such metal which is typically used as the main constituent of casting grain often contains large quantities of dissolved oxygen and as previously explained the saturation solubility of oxygen in molten silver is about 0.3 wt %. The thermodynamics of oxidising constituents of casting grain used in the present method (calculated for 1000° C.) is summarised in the following table:

| | |
|---|---|
| $Si + O_2 = SiO_2$ | $\Delta G° = -907030 + 175.7T = -731{,}330$ kJ mol$^{-1}$ $O_2$ |
| $\frac{4}{3}B + O_2 = \frac{2}{3}B_2O_3$ | $\Delta G° = -827040 + 147.9T = -679{,}500$ kJ mol$^{-1}$ $O_2$ |
| $2Zn + O_2 = 2ZnO$ | $\Delta G° = -711120 + 214.1T = -497{,}020$ kJ mol$^{-1}$ $O_2$ |
| $Ge + O_2 = GeO_2$ | $\Delta G° = -577780 + 191.3T = -386{,}480$ kJ mol$^{-1}$ $O_2$ |
| $4Cu + O_2 = 2Cu_2O$ | $\Delta G° = -344180 + 147.2T = -196{,}980$ kJ mol$^{-1}$ $O_2$ |
| $2Cu_2O + O_2 = 4CuO$ | $\Delta G° = -290690 + 196.2T = -94{,}490$ kJ mol$^{-1}$ $O_2$ |
| $4Ag + O_2 = 2Ag_2O$ | $\Delta G° = +61780 + 132T = +70{,}220$ kJ mol$^{-1}$ $O_2$ |

The value for silver oxide is positive, indicating that silver oxide does not form under casting conditions. The more negative the quoted values, the more likely that the reaction will proceed. Germanium is a deoxidant, zinc is a stronger deoxidant, and boron and silicon are even more strongly deoxidising and when present in silver are the most susceptible to attack by oxygen. It will be apparent that the molten silver content, if not carefully deoxidised, could easily convert the boron grain refiner added in ppm amounts to oxide and could also easily convert added silicon e.g. in an amount of 0.7 wt % to oxide, and oxygen in the copper content could assist that process if assistance were needed.

For this reason it is preferred to firstly add to the melting vessel e.g. a graphite or silica crucible the bulk of the silver and copper needed to form the alloy, to bring the constituents to a melting temperature e.g. about 1000° C. and to deoxidise before adding further more oxygen-sensitive constituents.

Various ways of deoxidizing molten silver alloys are known. One possibility is to use a graphite cover and a hydrogen protective flame for an initial mixture of molten silver and copper, the graphite forming CO which reacts with oxygen in the molten metal, and optionally additionally with graphite stirring of the molten metal. Better results are obtainable by covering the silver with graphite powder of particle size >5 mm. However, such measures may not be effective, especially if the furnace as a whole is open to ambient air and does not have provision for vacuum or a protective atmosphere and if protective conditions are not maintained during subsequent pouring and processing. In an embodiment silver and copper are melted together e.g. in a graphite crucible and held at a casting temperature of ~1000° C. A protective atmosphere e.g. of nitrogen or argon is provided above the melt and dissolved oxygen in the silver is removed by stirring the molten AgCu alloy with graphite rods. Melting in a closed furnace with a protective atmosphere or vacuum may give better deoxidation, the molten silver and copper being treated with a deoxidiser e.g. lithium metal red phosphorus or copper phosphorus. Lithium metal in small amounts is a known deoxidant for silver, and is volatile so that residual lithium in the silver alloy after deoxidation may be at the limits of detectability e.g. 2-3 ppm. Red phosphorus or copper phosphorus are alternatives and the reaction with dissolved oxygen can be mid, but if iron is present in the silver hard spots may form and the amount of residual phosphorus in the molten metal should be less than 30 ppm to avoid formation of copper phosphides.

The melt may then be reduced in temperature e.g. to about 825° C. to prevent excessive reaction as germanium enters the surface of the molten silver, after which the germanium is added e.g. in the form of particles which are dropped into the molten alloy or by wrapping the germanium in a known weight of copper or silver foil and plunging the resulting packet to the bottom of the crucible.

Zinc is a deoxidant and may be added, when present in the alloy, before silicon and boron.

Sodium borohydride used to add boron to the molten metal is a powerful deoxidant and may be used for that purpose in addition to addition of boron.

Irrespective of the deoxidant used, it is desirable that levels of oxygen in the casting grain produced should be <40 ppm, e.g. <30 ppm, more preferably <20 ppm and if possible <10 ppm.

When de-oxidation has been completed boron e.g. as Cu/B alloy or sodium borohydride and silicon in pure elemental form or as Cu/Si alloy may be added while maintaining the protective atmosphere, care being taken with addition of sodium borohydride because of the evolution of combustible hydrogen gas. The resulting alloy is poured under a protective atmosphere into a grain box or tundish and converted into casting grain. It will be appreciated that vacuum conditions may be employed as an alternative to a protective atmosphere. A minimum of delay between the end of deoxidation, the addition of silicon and boron and the casting into casting grain is desirable to minimise the risk of oxygen getting into the molten alloy and reacting with the boron and silicon constituents, resulting in an alloy with less than the intended amounts of these materials.

In a variation, the elemental silicon or Cu/B alloy may be added to the molten metal in the grain box or tundish while maintaining the protective atmosphere.

Re-melting of casing grain for investment casting is also carried out in a vacuum or under a protective atmosphere: if needed silicon and boron can be added at this stage. Castings should be maintained in a protective atmosphere for at least one minute before removal from the casting chamber, and allowed to stand, preferably in a protective atmosphere, for e.g. 20 minutes before quenching in water. Additional hardness may be obtained by allowing the flask to cool to room temperature before removing castings from the investment.

The invention is further illustrated in the following examples.

Examples 1 and 2

An embodiment of a 935 alloy (Example 1) has 93.5 wt % Ag, 1.1 wt % Ge, 700 ppm Si, 3-60 ppm e.g. 10 ppm B, the balance being copper. Hardness of the alloy on investment casting depends on the design of the article being cast and on the casting conditions. It is typically about 72 HV if the investment is cast at a temperature of about 950-1050° C. e.g. about 1000° C. into an investment at about 500-600° C. and allowed to cool for one minute in the flask chamber and about 30 minutes in air at which point it will have cooled to about 250° C., after which it is quenched in water. Subsequent heat treatment at about 300° C./2 hours can give a hardness of about 97 HV but for many applications may not be necessary as the as-cast hardness is similar to that of conventional Sterling silver.

An embodiment of a 960 alloy (Example 2) has 96 wt % Ag, 0.4-0.8 e.g. 0.65 wt % zinc, 0.6-0.8 e.g. 0.7 wt % Ge, 500-800 e.g. 700 ppm silicon, 3-60 e.g. 10 ppm boron, balance copper. Hardness of the alloy on investment casting as described above depends on the design of the article being cast and on the casting conditions but with the casting/cooling/quench conditions described above is typically about 52 HV. Subsequent heat treatment at about 300° C./2 hours can give a hardness of about 67 HV which is similar to that of conventional Sterling silver as cast, the reduction in hardness compared to the 935 alloy being partly the result of the reduced copper content and partly the result of zinc in the alloy.

Figure 2:
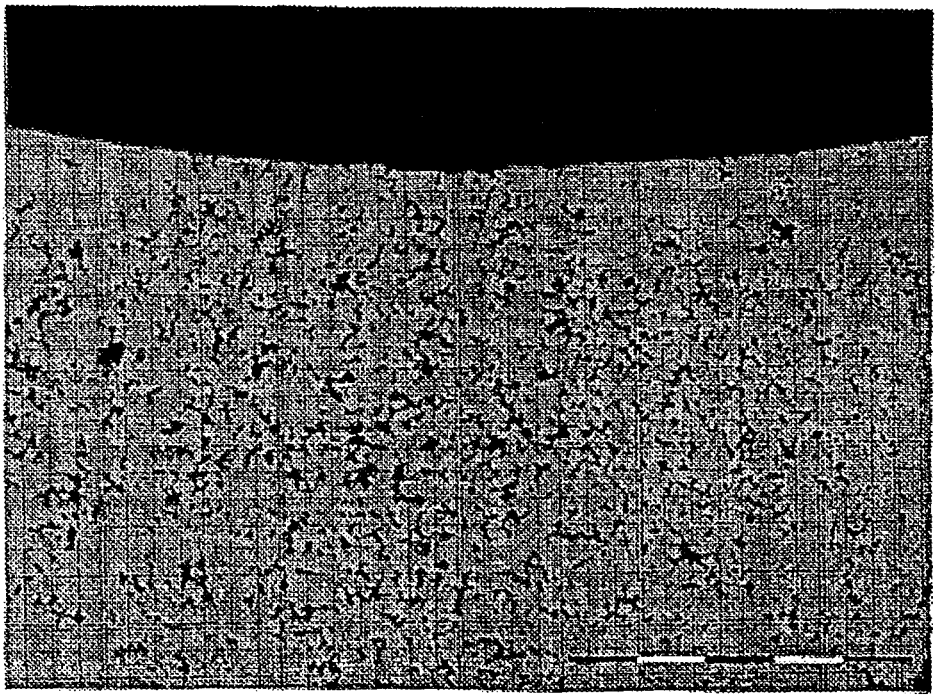
FIGS. 2-4 are micrographs showing sections of cast ring at position 7 in FIG. 1.
Figure 3:
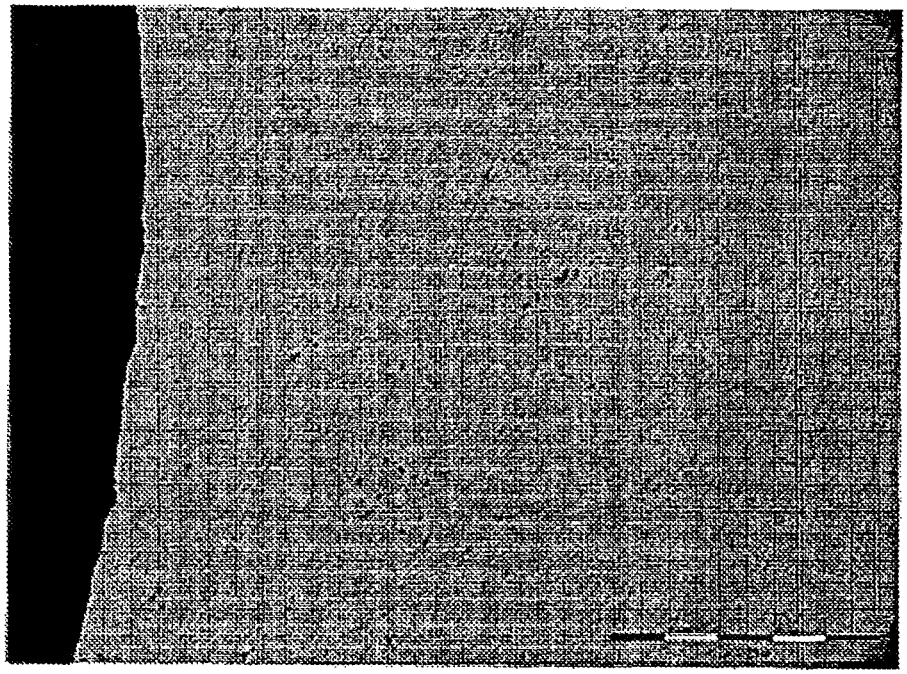
Figure 4:
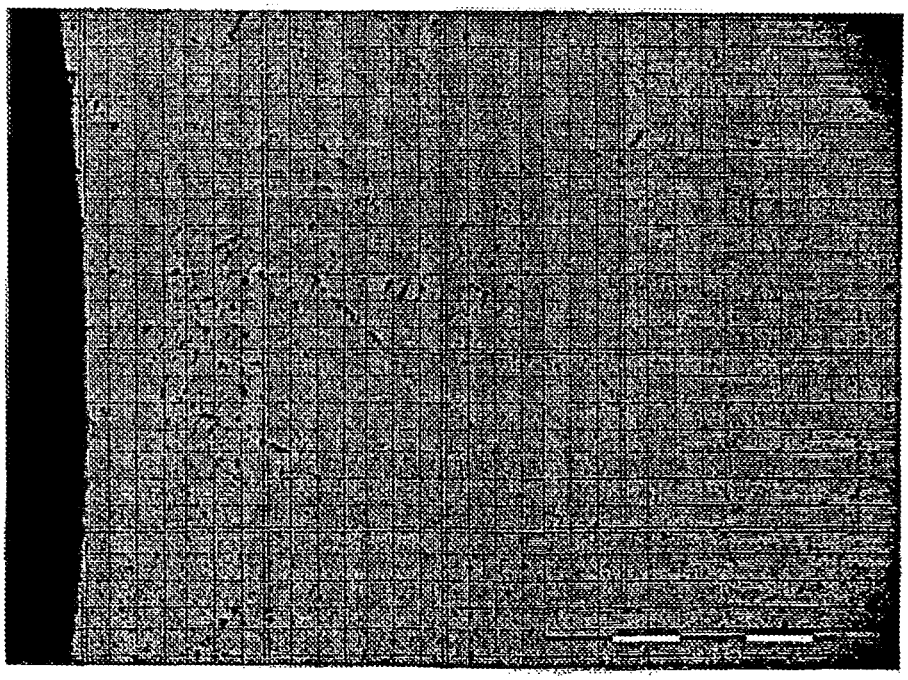

Both of the above alloys exhibit bright stain-free castings following investment casting and are either substantially crack and void-free or are significantly lower in voids, see FIG. 2 which shows a standard Sterling test casting for a ring exhibiting gross porosity and FIGS. 3-4 which are micrographs of the illustrated alloys in the vicinity of position 7 in FIG. 1 where the body of the ring joins the sprue and which show little or no porosity. It will be appreciated since molten metal contracts on cooling, a sprue should solidify last to allow molten metal to be fed to the cooling casting, as the metal contracts on cooling and to minimise development of shrinkage porosity. Therefore the most sensitive area to display shrinkage porosity (or the potential for cracking due to hot cracking or hot tearing) is the area where the sprue and item to be cast join. This is why P7 was chosen, as the region at which there was the greatest possibility of shrinkage porosity being present.

Castings in both the above alloys were bright and free from mould discoloration experienced with alloys not containing silicon.

Example 3

A quaternary silver-copper-germanium alloy (Ag=94.7 wt %, Ge=1.2 wt %, Cu=3.9 wt % Si=0.2 wt % (added as a Cu/Si master alloy), is prepared by melting silver, copper, germanium and master alloy together in a crucible by means of a gas-fired furnace which becomes heated to a pour temperature of about 2000° F. (1093° C.). The melt is covered with graphite to protect it against atmospheric oxidation and in addition a hydrogen gas protective flame is provided. Stirring is by hand using graphite stirring rods. When the above ingredients have become liquid, pellets of sodium borohydride to give up to 100 ppm boron e.g. 80 ppm are packaged or wrapped in pure silver foil of thickness e.g. about 0.15 mm. The foil wrapper holds the pellets of sodium borohydride in a single group and impedes individual pellets becoming separated and floating the surface of the melt. The wrapped pellets are placed into the hollow cupped end of a graphite stirring rod and plunged beneath the surface of the melt which at this stage is covered with a ceramic fibre blanket to quench the resulting flame from decomposition of the borohydride. The hydrogen burns off over a period of about 1-2 minutes with a stirring action being applied, after which evolution of hydrogen ceases and the boron content is substantially incorporated into the melt together with at least some of the sodium which is believed innocuous to properties of the resulting alloy.

After boron addition, the crucible pivots to permits the molten alloy to be poured into a tundish whose bottom is formed with fine holes. The molten silver pours into the tundish and runs through the holes in streams which break into fine pellets which fall into a stirred bath of water and become solidified and cooled. The cast pellets are removed from the bath and dried.

The resulting alloy granules are used in investment casting using traditional methods and using a calcium sulphate bonded investment, and are cast at a temperature of 950-980° C. and at a flask temperature of not more than 676° C. under a protective atmosphere. The investment material, which is of relatively low thermal conductivity, provides for slow cooling of the cast pieces. Investment casting with air-cooling for 15-25 minutes followed by quenching of the investment flask in water after 15-25 minutes gives a cast piece having an expected Vickers hardness of about 70, which is approximately the same hardness as sterling silver. The resulting casting has a matt silvery finish when removed from the mold, and an even finer grain structure than when Cu/B master alloy is used, due e.g. to the relatively high boron content permitted by the sodium borohydride and the energetic dispersion of the boron into the molten silver as the borohydride decomposition reaction proceeds. The alloy can be polished easily, is free from boron hard spots, and gives products that exhibit excellent tarnish and firestain resistance. Precipitation hardening to expected hardness values of e.g. about 110 Vickers can be achieved by subsequent torch annealing, quenching and reheating in an oven at about 300° C.

However, a harder cast piece can be produced by allowing the flask to cool in air to room temperature, the piece when removed from the flask having an expected Vickers hardness of about 110 which is similar to the value that can be achieved by the torch anneal/quench/reheat method. Contrary to experience with Sterling silver, where necessary, the hardness can be increased even further by precipitation hardening e.g. by placing castings or a whole tree in an oven set to about 300° C. for 20-45 minutes to give heat-treated castings of an expected hardness approaching 125 Vickers.

Example 4

A silver alloy is made by melting together 93.2 wt % fine silver casting grains, 1.3 wt % germanium in the form of small broken pieces, 0.2 wt % Si (added as a Cu/Si master alloy containing 10 wt % Si), the balance being copper granules. Melting is by means of an electric furnace which becomes heated to a pour temperature of about 1093° C. (2000° F.) having a melting crucible provided with ports for introduction of stirring gas, and the melt is protected by bubbling a stream of nitrogen gas through the melt to simultaneously effect stirring thereof, the nitrogen also providing a protective atmosphere.

When the above ingredients have become liquid, small quantities of diborane are added to the nitrogen stream passing through the melt over a period of 1-5 minutes to give a total boron content in the melt of about 50 ppm. The melt is covered with a ceramic fibre blanket to quench any resulting flame from decomposition of the diborane. The hydrogen burns off almost immediately on contact with the molten metal with a stirring action from the nitrogen stream, after which evolution of hydrogen ceases and the boron content has been substantially incorporated into the melt. After boron addition, the molten alloy is poured into a tundish whose bottom is formed with fine holes. The molten silver runs through the holes in fine streams which break into pellets which fall into a stirred bath of water and become solidified and cooled. The cast pellets are removed from the bath and dried. Pellets are tested by investment casting using a calcium sulphate bonded investment. The resulting casting has a matt silvery finish when removed from the mould, a fine grain structure and can be polished easily. It is free from boron hard spots and is ductile.

The invention claimed is:

1. A process for lost wax investment casting a germanium-containing silver alloy, consisting essentially of:

melting casting grain of a silver-copper germanium alloy comprising apart from impurities 93-95.5 wt % silver, 0.7-1.2 wt % germanium, 0.05-0.08 wt % silicon and 3-60 ppm boron as grain refiner, the balance copper, said alloy being free of added zinc;

pouring the molten alloy into a hydraulically set investment based on a gypsum binder;

allowing the investment and alloy to cool for at least one minute under a protective atmosphere, cooling the alloy in air, and subsequently quenching the alloy; and recovering a casting exhibiting tarnish and firestain resistance, having a clean silvery appearance when removed from the investment, substantially crack free and substantially free of shrinkage porosity.

2. The process of claim 1, wherein the casting comprises patterns attached to a tree.

3. The process of claim 2, wherein the alloy comprises 10 ppm boron.

4. The process of claim 1, wherein the oxygen content of the casting grain is <40 ppm.

5. The process of claim 1, wherein silver is about 93.5 wt %.

6. The process of claim 1, wherein germanium is 1.0-1.2 wt %.

7. The process of claim 1, wherein boron is present in the alloy in an amount of about 10 ppm.

8. The process of claim 1, further comprising reheating the casting at 150-400° C. to effect precipitation hardening thereof, reheating giving an increase of hardness of at least 15 HV.

9. The process of claim 1, wherein the alloy is made into a ring having claws, and further comprising the step of setting a stone into claws of the ring.

10. A process for lost wax investment casting a germanium-containing silver alloy, consisting essentially of:

melting casting grain of a silver-copper germanium alloy comprising apart from impurities 95.5-96 wt % silver, 0.7-1.2 wt % germanium, 0.4-0.8 wt % zinc, 0.05-0.08 wt % silicon and 3-60 ppm boron as grain refiner, the balance copper;

pouring the molten alloy into a hydraulically set investment based on a gypsum binder;

allowing the investment and alloy to cool for at least one minute under a protective atmosphere, cooling the alloy in air, and subsequently quenching the alloy; and recovering a casting exhibiting tarnish and firestain resistance, having a clean silvery appearance when removed from the investment, substantially crack free and substantially free of shrinkage porosity.

11. The process of claim 10, wherein the casting comprises patterns attached to a tree.

12. The process of claim 10, wherein the alloy comprises 0.7 wt % germanium.

13. The process of claim 10, wherein the oxygen content of the casting grain is <40 ppm.

14. A process for lost wax investment casting a germanium-containing silver alloy into a ring, said process consisting essentially of:

melting casting grain of a silver-copper germanium alloy comprising apart from impurities 93-95.5 wt % silver, 0.7-1.2 wt % germanium, 0.05-0.08 wt % silicon and 3-60 ppm boron as grain refiner, the balance copper, said alloy being free of added zinc;

pouring the molten alloy into a hydraulically set investment based on a gypsum binder and containing a pattern for said ring;

allowing the investment and alloy to cool for at least one minute under a protective atmosphere, cooling the alloy in air, and subsequently quenching the alloy; and recovering said ring as a casting exhibiting tarnish and firestain resistance, having a clean silvery appearance when removed from the investment, substantially crack free and substantially free of shrinkage porosity.

15. The process of claim 14, wherein casting is at a mold temperature of 500-600° C. using molten silver at 900-1050° C.

16. The process of claim 15, wherein the oxygen content of the casting grain is <40 ppm.

17. A process for lost wax investment casting a germanium-containing silver alloy, consisting essentially of:

melting casting grain of a silver-copper germanium alloy comprising apart from impurities 95.5-96 wt % silver, 0.7-1.2 wt % germanium, 0.4-0.8 wt % zinc, 0.05-0.08 wt % silicon and 3-60 ppm boron as grain refiner, the balance copper;

pouring the molten alloy into a hydraulically set investment based on a gypsum binder and containing a pattern for said ring;

allowing the investment and alloy to cool for at least one minute under a protective atmosphere, cooling the alloy in air, and subsequently quenching the alloy; and recovering said ring as a casting exhibiting tarnish and firestain resistance, having a clean silvery appearance when removed from the investment, substantially crack free and substantially free of shrinkage porosity.

18. The process of claim 17, wherein casting is at a mold temperature of 500-600° C. using molten silver at 900-1050° C.

19. The process of claim 18, wherein the oxygen content of the casting grain is <40 ppm.

20. A process for lost wax investment casting a germanium-containing silver alloy into a ring while avoiding reaction between germanium at the surface of the casting and sulphate of the investment giving rise to dark grey blemishes, said process consisting essentially of:

melting casting grain of a silver-copper germanium alloy comprising apart from impurities 93-95.5 wt % silver, 0.7-1.2 wt % germanium, 0.05-0.08 wt % silicon and 3-60 ppm boron as grain refiner, the balance copper, said alloy being free of added zinc;

pouring the molten alloy into a hydraulically set investment based on a gypsum binder and containing a pattern for said ring;

allowing the investment and alloy to cool for at least one minute under a protective atmosphere, cooling the alloy in air, and subsequently quenching the alloy; and recovering said ring as a casting exhibiting tarnish and firestain resistance, having a clean silvery appearance when removed from the investment, substantially crack free and substantially free of shrinkage porosity.

21. The process of claim 20, wherein casting is at a mold temperature of 500-600° C. using molten silver at 900-1050° C.

22. The process of claim 20, wherein the oxygen content of the casting grain is <40 ppm.

23. A process for lost wax investment casting a germanium-containing silver alloy into a ring while avoiding reaction between germanium at the surface of the casting and sulphate of the investment giving rise to dark grey blemishes, said process consisting essentially of:

melting casting grain of a silver-copper germanium alloy comprising apart from impurities 95.5-96 wt % silver, 0.7-1.2 wt % germanium, 0.4-0.8 wt % zinc, 0.05-0.08 wt % silicon and 3-60 ppm boron as grain refiner, the balance copper;

pouring the molten alloy into a hydraulically set investment based on a gypsum binder and containing a pattern for said ring;

allowing the investment and alloy to cool for at least one minute under a protective atmosphere, cooling the alloy in air, and subsequently quenching the alloy; and recovering said ring as a casting exhibiting tarnish and firestain resistance, having a clean silvery appearance when removed from the investment, substantially crack free and substantially free of shrinkage porosity.

24. The process of claim 23, wherein casting is at a mold temperature of 500-600° C. using molten silver at 900-1050° C.

25. The process of claim 23, wherein the oxygen content of the casting grain is <40 ppm.

* * * * *